US006852378B2

(12) United States Patent
Tsuchida et al.

(10) Patent No.: US 6,852,378 B2
(45) Date of Patent: Feb. 8, 2005

(54) SHEET FOR INK JET-RECORDING

(75) Inventors: Tetsuo Tsuchida, Hyogo (JP); Jun Nishio, Hyogo (JP); Masahiro Morie, Hyogo (JP)

(73) Assignee: Oji Paper Co., Ltd., Tokyo (JP)

( * ) Notice: Subject to any disclaimer, the term of this patent is extended or adjusted under 35 U.S.C. 154(b) by 0 days.

(21) Appl. No.: 10/668,497

(22) Filed: Sep. 22, 2003

(65) Prior Publication Data

US 2004/0058099 A1 Mar. 25, 2004

Related U.S. Application Data

(62) Division of application No. 09/971,743, filed on Oct. 4, 2001, now Pat. No. 6,652,930.

(30) Foreign Application Priority Data

| | | |
|---|---|---|
| Oct. 5, 2000 | (JP) | 2000-306042 |
| Oct. 27, 2000 | (JP) | 2000-328193 |
| Feb. 19, 2001 | (JP) | 2001-41444 |
| Mar. 30, 2001 | (JP) | 2001-099029 |
| May 8, 2001 | (JP) | 2001-137180 |

(51) Int. Cl.[7] ..... B41M 5/40

(52) U.S. Cl. ..... 428/32.24; 428/32.31; 428/32.38; 427/256; 427/288; 524/81; 524/236; 524/289; 524/303

(58) Field of Search ..... 428/32.24, 32.31, 428/32.38; 427/256, 288; 524/81, 236, 289, 303

(56) References Cited

U.S. PATENT DOCUMENTS 6,492,005 B1 12/2002 Ohbayashi et al.

FOREIGN PATENT DOCUMENTS

| | | |
|---|---|---|
| EP | 1 034 940 A1 | 9/2000 |
| EP | 1 138 509 A2 | 10/2001 |
| EP | 1 138 509 A3 | 10/2001 |
| EP | 1 195 259 A2 | 4/2002 |
| JP | 01 036479 A | 2/1989 |
| JP | 01 115677 A | 5/1989 |
| JP | 2002-127584 | 5/2002 |
| JP | 2002-160447 | 6/2002 |
| JP | 2002-316475 | 10/2002 |

OTHER PUBLICATIONS

DWPI 2002–501880 (Nov. 19, 2002) Morie, M.; Nishio, J.; Tshuchida T.

Patent Abstract of Japan 2001–191640 (Jul. 17, 2001) Satoshi et al. (Machine Translation).

Patent Abstract of Japan 2001–191641 (Jul. 17, 2001) Satoshi et al. (Machine Translation).

Patent Abstract of Japan 2001–270220 (Oct. 2, 2001) Yukihiro et al. (Machine Translation).

Patent Abstract of Japan 2001–315432 (Nov. 13, 2001) Satoshi et al. (Machine Translation).

Patent Abstract of Japan 2001–341414 (Dec. 11, 2001) Yukihiro et al. (Machine Translation).

Patent Abstract of Japan 2001–341418 (Dec. 11, 2001) Hiroshi et al. (Machine Translation).

Patent Abstract of Japan 2001–260519 (Sep. 25, 2001) Satoshi et al. (Machine Translation).

Patent Abstract of Japan 2002–137532 (May 14, 2002) Satoshi et al. (Machine Translation).

EPO, *European Search Report*, App. No. EP 01 30 8431, Mar. 18, 2004, 2 pgs.

*Primary Examiner*—B. Shewareged

(74) *Attorney, Agent, or Firm*—Christie, Parker & Hale, LLP

(57) ABSTRACT

An ink jet-recording sheet for forming recorded images using liquid ink comprises a combination of specific compounds, for instance, 1,2-bis(2-hydroxyethylthio)ethane and a homopolymers or copolymer of diallylamine type compounds such as poly(diallylamine)hydrochloride, poly (diallylamine)sulfate, poly(diallylamine) phosphate or poly (diallylamine)acetate. The ink jet-recording sheet can ensure a high density of printed images, can provide images having high quality, shows only a slight color change and discoloration of printed images even when exposed to ozone gas and is excellent in the long-term shelf life.

14 Claims, No Drawings

SHEET FOR INK JET-RECORDING

CROSS-REFERENCE TO RELATED APPLICATIONS

This application is a divisional of U.S. application Ser. No. 09/971,743, filed Oct. 4, 2001, now patented as U.S. Pat. No. 6,652,930 B2, which claims priority of Japanese Patent Application No. 2000-306042, filed Oct. 5, 2000; Japanese Patent Application No. 2000-328193, filed Oct. 27, 2000; Japanese Patent Application No. 2001-41444, filed Feb. 19, 2001; Japanese Patent Application No. 2001-099029, filed Mar. 30, 2001; and Japanese Patent Application No. 2001-137180, filed May 8, 2001, the entirety of which are incorporated herein by reference.

BACKGROUND OF THE INVENTION

The present invention relates to a SHEET FOR INK JET-RECORDING for use in forming recorded images using liquid ink such as water-based ink and, in particular, to a sheet for ink jet-recording (an INK JET-RECORDING SHEET), which never undergoes any color change during or after long-term storage, which is a disadvantage observed for the conventional ink jet-recording sheet, while maintaining such advantages that it can ensure a high density of full color-printed images formed thereon and that it is excellent in ink absorptivity.

The ink jet-recording system, in which images are formed by injecting water-based ink on a recording medium through a fine nozzle, has widely been used in, for instance, printers for terminal devices, facsimiles, plotters or devices for printing account books and slips. This is because, for instance, it has a low noise level during recording operations; it easily permits the color printing; it also permits high-speed recording; and it is less expensive as compared with other printing devices.

On the other hand, printers have rapidly been popularized recently and they have increasingly been required to give finer and more precise images at a high speed. In addition, there has recently been developed a digital camera. Correspondingly, recording mediums have been required to have higher recording characteristic properties. More specifically, there has been desired for the development of a recording medium, which is not only excellent in ink absorptivity, recording density, water resistance and storability, but also has image quality and shelf life almost comparable to those observed for the images formed on the silver halide system.

To satisfy such requirements, there have been proposed a large number of sheets each comprising a substrate provided thereon with an ink-receiving layer, which mainly comprises a pigment and a binder. For instance, there have been reported a variety of methods for applying, onto substrates, a coating layer comprising amorphous silica and a polymer binder (Japanese Un-Examined Patent Publication (hereunder referred to as "J.P. KOKAI" No. Sho 55-51583, J.P. KOKAI No. Sho 57-157786 and J.P. KOKAI No. Sho 62-158084); a coating layer comprising an ink-adsorbing pigment such as zeolite (J.P. KOKAI No. Sho 56-144172); a coating layer comprising finely pulverized silicic acid and a water-soluble resin (J.P. KOKAI No. Sho 56-148583); and a coating layer comprising a porous and cationic alumina hydrate (J.P. KOKAI No. Sho 60-232990).

Moreover, there have also been proposed methods, which comprise incorporating, for instance, cationic polymers (J.P. KOKAI No. Sho 56-84992, J.P. KOKAI No. Sho 60-49990 and J.P. KOKAI No. Sho 61-125878); and basic latexes (J.P. KOKAI No. Sho 57-36692) into the ink-receiving layers, in order to improve the water resistance of printed letters.

Furthermore, there have also been proposed, for instance, methods, which comprise adding, to the ink-receiving layer, at least one member selected from the group consisting of metal oxides and metal chlorides such as phosphorus tungstate, phosphorus molybdate and chromic chloride, and tannic acid (J.P. KOKAI No. Sho 57-87987); an antioxidant such as a hindered phenol (J.P. KOKAI No. Sho 57-74192); hindered amines (J.P. KOKAI No. Sho 61-146591); UV light absorbers such as benzophenone type, benzotriazole type and phenyl salicylic acid type ones (J.P. KOKAI No. Sho 57-74193, J.P. KOKAI No. Sho 57-87988 and J.P. KOKAI No. Sho 63-222885); a thiourea type compound (J.P. KOKAI No. Sho 61-163886); a specific mercapto compound such as 2-mercaptobenzothiazole and 2-mercaptobenzimidazole (J.P. KOKAI No. Sho 61-177279); and a dithiocarbamic acid salt, a thiuram salt, a thiocyanic acid ester or a thiocyanic acid salt (J.P. KOKAI No. Hei 7-314882).

However, the full color ink jet recorded images formed according to these techniques suffer from a problem of color change during a long-term storage and in particular, when a phthalocyanine dye is used as the dye for cyan color ink, these techniques have still been insufficient since the images cause color change along with the discoloration of the phthalocyanine dye.

SUMMARY OF THE INVENTION

Accordingly, it is an object of the present invention to provide an ink jet-recording sheet, which does not suffer from the drawbacks associated with the conventional ink jet-recording sheet, and more specifically to an ink jet-recording sheet, which never undergoes any color change during or after a long-term storage even when the sheet is subjected to full color printing operations and which permits the considerable reduction of such color change, particularly observed when a phthalocyanine dye is used as the dye for cyan color ink, along with the discoloration of the phthalocyanine dye.

The inventors of this invention have conducted various studies of an ink jet-recording sheet for forming recorded images using liquid ink such as water-based ink, have found that when incorporating, into the recording sheet, a specific compound including a sulfur atom in the molecule and a polymer of a diallylamine type compound, an ink jet-recording sheet free of any drawback associated with the conventional ink jet-recording sheet can be obtained and more specifically, the resulting ink jet-recording sheet never undergoes any color change during or after a long-term storage even when the sheet is subjected to full color printing operations and the sheet permits the considerable reduction of such color change, particularly observed when a phthalocyanine dye is used as the dye for cyan color ink, along with the discoloration of the phthalocyanine dye, and thus have completed the present invention.

According to the present invention, there is thus provided an ink jet-recording sheet for forming recorded images using liquid ink, wherein the sheet comprises (a) at least one member selected from the group consisting of those represented by the following general formulae (1) to (5) and salts of compounds represented by the following general formulae (3) and (4); and (b) at least one member selected from the group consisting of homopolymers of diallylamine compounds represented by the following general formula (6) and copolymers of the compounds of formula (6) with copolymerizable ethylenically unsaturated compounds.

$$HO—(C_2H_4(S)_r)_p—R_1 \quad (1)$$

$$R_2—(S)_t—(CH_2)_q—(S)_t—R_3 \quad (2)$$

$$HOOC—(CH_2)_1—(S)_n—(CH_2)_m—COOH \quad (3)$$

(4)

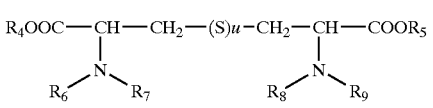

(5)

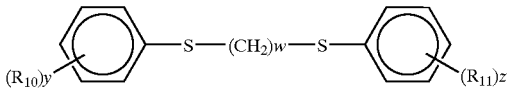

(6)

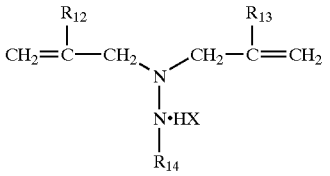

wherein $R_1$, $R_2$ and $R_3$ each represents a $C_1$ to $C_4$ alkyl group, a $C_1$ to $C_4$ hydroxyalkyl group or a $C_1$ to $C_4$ dihydroxyalkyl group; $R_4$ and $R_5$ each represent a hydrogen atom or a $C_1$ to $C_4$ alkyl group; $R_6$ to $R_9$ each represents a hydrogen atom, a $C_1$ to $C_4$ alkyl group, a $C_1$ to $C_4$ alkylcarbonyl group or a benzoyl group; $R_{10}$ and $R_{11}$ each represents a $C_1$ to $C_4$ alkyl group or a $C_1$ to $C_4$ alkoxy group; $R_{12}$ and $R_{13}$ each represents a hydrogen atom or a methyl group; $R_{14}$ represents a hydrogen atom or a $C_1$ to $C_4$ alkyl group; and HX represents an acid, and p represents an integer ranging from 1 to 3; q represents an integer ranging from 1 to 6; r, t, n and u each represents 1 or 2; 1 and m each represents an integer ranging from 1 to 11; w represents an integer ranging from 1 to 6; y and z each represents 0 or an integer ranging from 1 to 3.

DETAILED DESCRIPTION OF THE INVENTION

The present invention will now be described in more detail with reference to the following preferred embodiments. Specific examples of the compounds represented by formulas (1) and (2) include 2,2'-thiodiethanol, 2,2'-dithiodiethanol, 1,2-bis(2-hydroxyethylthio)ethane, 1,2-bis(2-hydroxyethyldithio)ethane, 2,2'-bis(2-hydroxyethylthio)diethyl sulfide, 2,2'-bis(2-hydroxyethylthio)diethyl disulfide, bis(2-hydroxyethylthio)methane, bis(2-hydroxyethyldithio)methane, 1,3-bis(2-hydroxyethylthio)propane, 1,3-bis (2-hydroxyethyl-dithio)propane, 1,4-bis(2-hydroxyethylthio)butane, 1,4-bis(2-hydroxyethyldithio)butane, 1,6-bis(2-hydroxyethylthio)hexane, 1,6-bis(2-hydroxyethyldithio)hexane, ethylthioethanol, ethyldithioethanol, n-propylthioethanol, isopropylthioethanol, isopropyldithioethanol, n-butylthioethanol, 1-ethylthio-1-(2-hydroxyethylthio)methane, 1-ethylthio-2-(2-hydroxyethylthio)ethane, 1-ethylthio-3-(2-hydroxyethylthio)propane, 1-ethylthio-4-(2-hydroxyethylthio)butane, 1,1-bis(2,3-dihydroxypropylthio)methane, 1,2-bis(2,3-dihydroxypropylthio)ethane, 1,3-bis(2,3-dihydroxypropyldithio)propane, 1,4-bis(2,3-dihydroxypropylthio)butane, 1,6-bis(2,3-dihydroxypropylthio)hexane and 1-ethylthio-2-(2,3-dihydroxy-propylthio)ethane.

Among these compounds, particularly preferably used herein are 1,2-bis(2-hydroxyethylthio)ethane and 1,4-bis(2-hydroxyethylthio)butane because of their high color change-inhibitory effect and high safety.

Specific examples of the compounds represented by formula (3) are 2,2'-thiodiglycolic acid, 3,3'-thiodipropionic acid, 4,4'-thiodibutanoic acid, 6,6'-thiodicaproic acid, 8,8'-thiodicaprylic acid, 10,10'-thiodicapric acid, 12, 12'-thiodilauric acid, 2,2'-dithiodiglycolic acid, 3,3'-dithiodipropionic acid, 4,4'-dithiodibutanoic acid, 6, 6'-dithiodicaproic acid, 8,8'-dithiodicaprylic acid, 10,10'-dithiodicapric acid and 12,12'-dithiodilauric acid.

Among these compounds, particularly preferably used herein are 3,3'-thiodipropionic acid and 3,3'-dithiodipropionic acid because of their high color change-inhibitory effect and high safety.

Specific examples of the compounds represented by the general formula (4) are 3,3'-dithiobis(2-aminopropionic acid), 3,3'-thiobis(2-aminopropionic acid), dimethyl 3, 3'-dithiobis(2-aminopropionate), dimethyl 3,3'-thiobis (2-aminopropionate), diethyl 3,3'-dithiobis(2-aminopropionate), diethyl 3,3'-thiobis(2-aminopropionate), diisopropyl 3,3'-dithiobis(2-aminopropionate), di n-butyl 3,3'-dithiobis(2-aminopropionate), 3,3'-dithiobis(2-N-acetyl aminopropionic acid), 3,3'-thiobis(2-N-acetylaminopropionic acid), dimethyl 3,3'-dithiobis(2-N-acetylaminopropionate), dimethyl 3,3'-thiobis(2-N-acetyl aminopropionate), dimethyl 3,3'-dithiobis(2-N-benzoyl aminopropionate) and dimethyl 3,3'-thiobis(2-N-benzoyl aminopropionate).

Particularly preferably used herein is 3,3'-dithiobis (2-aminopropionic acid) among others, because of its high color change-inhibitory effect and high safety.

Specific examples of the compounds represented by the foregoing general formula (5) are 1,2-bis(phenylthio)ethane, 1,3-bis(phenylthio)propane, 1,4-bis (phenylthio)butane, 1,5-bis(phenylthio)pentane, 1,6-bis(phenylthio)hexane, 1,2-bis (4-methylphenylthio)ethane, 1,4-bis(4-methylphenylthio) butane, 1,6-bis (4-methylphenylthio)hexane, 1-phenylthio-2-(4-methylphenylthio)ethane, 1-phenylthio-4-(4-methylphenylthio)butane, 1-phenylthio-6-(4-methylphenylthio)hexane, 1,4-bis(2-methylphenylthio) butane, 1,4-bis(3-methylphenylthio)butane, 1,4-bis(3,4-dimethylphenylthio)butane, 1,4-bis(2,3,4-trimethylphenylthio)butane, 1,4-bis(4-ethylphenylthio) butane, 1,4-bis(4-t-butylphenylthio)butane, 1, 2-bis(4-methoxyphenylthio)ethane, 1,4-bis(4-methoxyphenylthio) butane, 1,6-bis(4-methoxyphenylthio)hexane, 1,4-bis(4-isopropoxyphenylthio)butane, 1-phenylthio-4-(4-methoxyphenylthio)butane and 1-phenylthio-4-(4-isopropoxyphenylthio)butane.

In this respect, particularly preferably used herein are 1,4-bis(phenylthio)butane and 1,6-bis(phenylthio)hexane among others, because of their high color change-inhibitory effect.

Examples of ions as the counterparts of the salts of the compounds represented by the general formula (3) or (4) include sodium, potassium, magnesium, calcium, ammonium and zinc.

The acid represented by the foregoing general formula HX of (6) may be either inorganic or organic ones and specific examples thereof include inorganic acids such as hydrochloric acid, sulfuric acid, nitric acid, phosphoric acid, pyrophosphoric acid and metaphosphoric acid; and organic acids such as formic acid, acetic acid, propionic acid, methanesulfonic acid and p-toluenesulfonic acid. Among these acids, particularly preferably used herein are hydrochloric acid and sulfuric acid, because of their high color change-inhibitory effect. In the foregoing formulas, $R_{12}$, $R_{13}$ and $R_{14}$ preferably represent a hydrogen atom.

Examples of the homopolymers and copolymers of the diallylamine compounds represented by the general formula (6) are poly(diallylamine)hydrochloride, poly(diallylamine) sulfate, poly(diallylamine)phosphate, poly(diallylamine) acetate, poly(diallylamine)propionate, poly(diallylamine) methanesulfonate, poly(diallylmethylamine)hydrochloride, poly(diallylmethylamine)sulfate, poly(diallylethylamine) hydrochloride, poly(diallylethylamine)sulfate, poly(diallyl-n-propylamine)hydrochloride, poly(diallyl-n-butylamine) hydrochloride, poly(di-2-methylallylamine)hydrochloride, poly(di-2-methylallylamine)sulfate, diallylamine hydrochloride-acrylamide copolymer, diallylamine sulfate-acrylamide copolymer, diallylamine phosphate-acrylamide copolymer, diallylmethylamine hydrochloride-acrylamide copolymer, diallylmethylamine sulfate-acrylamide copolymer, diallylmethylamine phosphate-acrylamide copolymer, diallylethylamine hydrochloride-acrylamide copolymer, diallylamine hydrochloride-sulfur dioxide copolymer, diallylamine sulfate-sulfur dioxide copolymer, diallylmethylamine hydrochloride-sulfur dioxide copolymer and diallylethylamine hydrochloride-sulfur dioxide copolymer. Among these polymers and copolymers, preferably used herein are those having a molecular weight ranging from 10,000 to 200,000.

These polymers and copolymers ensure the achievement of the synergistic effects of improving water resistance and color change-inhibition.

As has been discussed above, full color ink jet-recorded images undergo color change during a long-term storage and, in particular, when a phthalocyanine dye is used as the dye for cyan color ink, a significant color change is observed along with the discoloration of the dye. It would be recognized that this color change is caused due to the easy and preferential oxidation of the cyan dye carrying a phthalocyanine skeleton by gases present in the air, in particular, those having a strong oxidative effect such as ozone.

Although the reason why the compounds represented by the general formulas (1) to (5) and salts of the compounds of formulas (3) and (4) are particularly effective in the inhibition of any color change of the ink jet-recording sheet has not yet been clearly elucidated, it would be recognized that the compounds of formulas (1) to (5) and the salts of the compounds of formulas (3) and (4) are quite susceptible to a gas having a strong oxidative effect such as ozone, that they are accordingly oxidized prior to the oxidation of the cyan dye and therefore, the cyan dye is protected from any oxidation.

Moreover, the compounds formed through the oxidation of the compounds of formulas (1) to (5) and salts of formulas (3) and (4) are colorless and therefore, it is important characteristic properties of the ink jet-recording sheet of the present invention that it does not suffer from a problem of, for instance, any yellowing of the sheet thereof.

The content of the compounds represented by the foregoing formulas (1) to (5) and salts of formulas (3) and (4) in the ink jet-recording sheet is on the order of about 0.1 to 4 $g/m^2$ and preferably 0.2 to 2 $g/m^2$. This is because if the content thereof is less than 0.1 $g/m^2$, the intended effect of improving the shelf life of the recorded images may be insufficient, while if it exceeds 4 $g/m^2$, the quality of the resulting images may be impaired.

The content of the homopolymers and copolymer of the compound represented by formula (6) in the ink jet-recording sheet in general ranges from 1 to 100 parts by weight and preferably 5 to 50 parts by weight per 100 parts by weight of the pigment. This is because if the content thereof is less than the lower limit, the resulting sheet may be insufficient in the effect of improving the shelf life and it is difficult to obtain the desired effects of improving, for instance, the water resistance and density of printed letters. On the other hand, if the content exceeds the upper limit, the density of printed letters may be reduced and images may cause bleeding.

As methods for preparing an ink jet-recording sheet comprising the compound represented by the foregoing formulas (1) to (5) and salts of formulas (3) and (4) and the homopolymers or copolymer of the compound of the general formula (6), there may be listed, for instance, a method in which base paper is coated or impregnated with a coating liquid containing specific compounds using a size press, for instance, during paper-making process; a method which comprises the steps of applying a coating liquid for forming an ink-receiving layer prepared by mixing an ink absorptive pigment, an adhesive and specific compounds onto a substrate such as paper (acidic paper, neutral paper), synthetic paper, a plastic film or a non-woven fabric using a coating machine and then drying the coated layer to give an ink-receiving layer; and a method which comprises the step of applying a coating liquid containing specific compounds onto the surface of an ink-receiving layer comprising a pigment, an adhesive and a specific polymer.

Among these methods, preferably used herein is the method in which the foregoing specific compounds are incorporated into the ink-receiving layer since the method is highly effective in inhibiting any color change of images.

If the compounds of the foregoing formulas (1) to (5) and the salts of the compounds of formulas (3) and (4) are soluble in water, an aqueous solution thereof is incorporated into a coating liquid for forming an ink-receiving layer or applied onto an ink-receiving layer. On the other hand, if they are less soluble in water, they are finely pulverized in an agitation-pulverization machine such as a ball mill, an attritor, a sand mill or a colloid mill, while using water as a dispersion medium.

Examples of substrates for ink jet-recording sheets usable herein are paper (acidic paper, neutral paper), synthetic paper, a plastic film, a non-woven fabric, a plastic film laminated with coated paper or wood-free paper through an adhesive layer or a laminate of paper with a plastic film. Examples of such plastic films are polyester, polypropylene and nylon films.

Examples of pigments to be incorporated into the ink-receiving layer are zeolite, precipitated calcium carbonate, ground calcium carbonate, magnesium carbonate, kaolin, talc, calcium sulfate, barium sulfate, titanium oxide, zinc oxide, zinc sulfide, zinc carbonate, satin white, aluminum silicate, diatomaceous earth, calcium silicate, magnesium silicate, amorphous silica, aluminum hydroxide, alumina, alumina hydrate, aluminosilicate, lithopone and urea-formalin resin filler. These pigments may be used alone or in any combination of at least two of them.

Preferably used herein are amorphous silica, alumina and alumina hydrate among others, because of their excellent ink-absorbing capacity.

The amount of these pigments to be incorporated into the ink-receiving layer ranges from about 20 to 90% by weight and preferably 30 to 80% by weight on the basis of the total weight of the solid contents of the ink-receiving layer. In this respect, if the amount of the pigment exceeds 90% by weight, the resulting ink-receiving layer may have reduced film strength, while if the amount thereof is less than 20% by weight, the resulting ink-receiving layer may have a reduced ink-absorbing capacity and insufficient ink-drying properties after recording and the quality of images may correspondingly be impaired.

Moreover, in the present invention, it is also possible to simultaneously use a polymer, which shows cationic characteristics through dissociation when dissolved or emulsified in water, as a cationic polymer component. Examples of such cationic polymers are poly(diallyldimethylammonium chloride), diallyldimethylammonium chloride-acrylamide copolymer, diallyldimethylammonium chloride-sulfur dioxide copolymer, poly(allylamine)hydrochloride, allylamine hydrochloride-diallylamine hydrochloride copolymer, N-vinyl acrylamidine hydrochloride-acrylamide copolymer, dialkylamine-epichlorohydrin addition polymer, polyamide polyamine epichlorohydrin polymerized product, dicyandiamide-formalin polycondensate, polyethylene polyamine-dicyandiamide polycondensate, poly (ethyleneimine)hydrochloride, poly(meth)acryloyloxyalkyl dialkylamine hydrochloride, (meth)acryloyloxyalkyl dialkylamine hydrochloride-acrylamide copolymer, poly(meth) acryloyloxyalkyl trialkylammonium chloride, (meth) acryloyloxyalkyl trialkylammonium chloride-acrylamide copolymer, poly(meth)acrylamide alkyldialkylamine hydrochloride, (meth)acrylamide alkyldialkylamine hydrochloride-acrylamide copolymer, poly(meth) acrylamide alkyl trialkylammonium chloride and (meth) acrylamide alkyl trialkylammonium chloride-acrylamide copolymer.

The ink-receiving layer further comprises, as an adhesive, for instance, aqueous adhesives such as starch derivatives such as oxidized starch and etherified starch; cellulose derivatives such as carboxymethyl cellulose and hydroxyethyl cellulose; casein, gelatin, soybean protein, completely (or partially) saponified polyvinyl alcohol, silanol-modified polyvinyl alcohol, acetoacetyl group-modified polyvinyl alcohol, salts of styrene-maleic anhydride copolymer, styrene-butadiene type latexes, acryl type latexes, polyester polyurethane type latexes and vinyl acetate type latexes; or organic solvent-soluble resins such as poly (methyl methacrylate), polyurethane resins, unsaturated polyester resins, vinyl chloride-vinyl acetate copolymer, polyvinyl butyral and alkyd resins. These adhesives may be used alone or in any combination.

These adhesives are in general used in an amount ranging from about 1 to 200 parts by weight and preferably about 10 to 100 parts by weight per 100 parts by weight of the pigment.

Further, the ink-receiving layer may additionally comprise other additives such as a pigment dispersant, a thickening agent, a cross-linking agent, a fluidity-improving agent, an anti-foaming agent, a foam-inhibitor, a releasing agent, a foaming agent, a penetrating agent, a coloring dye, a coloring pigment, a fluorescent brightener, an antiseptic agent, an anti-fungus agent and/or a water resistance-imparting agent, in an appropriate amount.

The ink-receiving layer can be prepared by applying a coating liquid for forming ink-receiving layers onto at least one side of a substrate using a coating means such as a bar coater, a blade coater, an air-knife coater, a gravure coater, a die coater or a curtain coater, in a coated amount, as determined after drying, ranging from about 2 to 30 g/m$^2$ and then drying the coated layer. This is because if the coated amount is less than 2 g/m$^2$, the quality of the resulting image may be impaired, while if it exceeds 30 g/m$^2$, the resulting sheet may have reduced film strength.

After the formation of the ink-receiving layer, the ink jet-recording sheet may be passed through a roll nip under pressure using, for instance, a super calendar or a gloss-calendar to thus impart surface smoothness to the layer in order to, for instance, make the layer highly glossy.

A glossy layer may further be applied onto the foregoing ink-receiving layer. This glossy layer may principally comprise a resin. Moreover, the glossy layer may likewise comprise a pigment in addition to the resin. The glossy layer is preferably porous or permeable to liquids insofar as the glossiness is never impaired so that ink may rapidly pass through the layer or may be absorbed by the same. To this end, it is desirable to incorporate a pigment into the layer or to select such drying conditions that the resin is not completely converted into a film and that the glossiness is not impaired.

Pigments used in the glossy layer may be the same as those listed above in connection with the ink-receiving layer, but preferred are, for instance, colloidal silica, amorphous silica, aluminum oxide, aluminosilicate, zeolite and synthetic smectite, because of their excellent glossiness, transparency and ink-absorbing ability. These pigments are desirably included in the glossy layer in an amount ranging from 10 to 80% by weight. The higher the specific surface area of a pigment as determined according to the BET formula, the higher the ink-absorbing ability thereof and therefore, the specific area thereof is preferably not less than 150 m$^2$/g. The average particle size of the pigment preferably ranges from 0.01 to 5 $\mu$m and more preferably 0.05 to 1 $\mu$m. If using, as a pigment, fine silica particles whose average particle size of the primary particles is not less than 3 nm and not more than 40 nm and whose average particle size of the secondary particles is not less than 10 nm and not more than 500 nm, the resulting product is particularly excellent in the glossiness and printed density. If the glossy layer comprises a pigment as a main component (10 to 80 wt %), the resulting product is particularly excellent in the ink-absorbing ability.

In this case, the glossy layer is excellent in both the ink-absorbing ability and transparency. Therefore, if a cationic compound is incorporated into the glossy layer, a dye for ink is effectively fixed to the glossy layer and the product is liable to be quite excellent in the printed density because of the synergistic effect with the transparency of the glossy layer.

Examples of resins used for forming the glossy layer are water-soluble resins (for instance, polyvinyl alcohols such as polyvinyl alcohol, cation-modified polyvinyl alcohol and silanol-modified polyvinyl alcohol; casein, soybean proteins, synthetic proteins, starches; and cellulose derivatives such as carboxymethyl cellulose and methyl cellulose); water-dispersible resins, for instance, conjugated diene polymer type latexes such as styrene-butadiene copolymer, styrene-acrylates and copolymer methyl methacrylate-butadiene copolymer latexes, vinyl copolymer type latexes such as styrene-vinyl acetate copolymer latexes; aqueous acrylic resins, aqueous polyurethane resins and aqueous polyester resins as well as a variety of resins (adhesives) known and currently used in the field of the coated paper. These resins for forming the glossy layer may be used alone or in any combination of at least two of them.

In this connection, if the glossy layer is mainly formed from a resin, it is particularly preferred to use, as a main component, a polymer or copolymer (hereunder collectively referred to as "polymer") obtained by polymerizing monomers having ethylenically unsaturated bonds (hereunder referred to as "ethylenic monomer"). It is also possible to use substituted derivatives of these polymers. Moreover, usable herein also include composites prepared by polymerizing the foregoing ethylenic monomers in the presence of colloidal silica to thus form Si—O—R (wherein R represents a polymer moiety) bonds between these components or those obtained by introducing, in advance, functional groups reactive with colloidal silica such as SiOH groups into the foregoing polymers and then reacting the product with colloidal silica. If such a composite is used, the resulting product is liable to be excellent in the glossiness and ink-absorbing ability.

Moreover, in another embodiment, if using a casting method, the resulting product may be excellent in the ability of releasing from the casting drum. The particle size of the composite particles is not restricted to any particular range, but the particle size, for instance, ranges from about 20 to 200 nm.

In an embodiment in which the glossy layer is formed by a casting method using a heated mirror-finishing drum, the foregoing polymer preferably has a glass transition temperature of not less than 40° C. and more preferably 50 to 100° C. If the polymer has a lower glass transition temperature, the film-forming rate during drying is extremely high and the surface porosity of the resulting film is reduced. This may in turn lead to the reduction of the ink-absorbing speed of the glossy layer. In addition, the drying temperature is an important factor. This is because if the drying temperature is too high, the film formation excessively proceeds during the drying step, the surface porosity of the resulting product is lowered and as a result, the ink-absorbing speed is reduced. On the other hand, if the drying temperature is too low, the resulting product has a tendency of reducing its glossiness and the productivity rate thereof is also reduced.

A composition for forming a glossy layer may appropriately comprise a variety of auxiliary agents generally used in the field of the coated paper for printing and ink jet-recording paper for the control of the whiteness, viscosity and flowability and examples thereof are pigments, anti-foaming agents, coloring agents, antistatic agents, antiseptics, dispersants, thickening agents and releasing agents. In addition, a cationic compound such as the foregoing cationic resins may be incorporated into the glossy layer to thus impart an ability of fixing dyes for ink even to the glossy layer. The coated amount of the glossy layer ranges from 0.2 to 30 g/m$^2$ and preferably 1 to 20 g/m$^2$, as expressed in terms of the amount of the solid contents.

In addition, an ink jet-recording sheet having higher surface glossiness may be obtained by, for instance, applying a gloss-developing layer and subjecting the layer to a casting treatment or directly subjecting the ink-receiving layer to a casting treatment. Such a casting treatment can be carried out by, for instance, a wet method, a gelation method and a re-wet method. The wet method comprises the steps of pressing a gloss-developing layer, which layer can be an ink jet-recording layer, applied onto a base paper against a heated mirror-finished drum surface while the gloss-developing layer is still in the wet condition to thus obtain highly glossy finishing. The gelation method comprises the steps of bringing a gloss-developing layer, which layer can be an ink jet-recording layer, applied onto base paper into contact with a gelling agent-containing bath while the gloss-developing layer is still in the wet condition and then pressing the gloss-developing layer in the gelatinized condition against a heated drum surface to thus obtain highly glossy finishing. The re-wet method comprises the steps of once drying a gloss-developing layer, which layer can be an ink jet-recording layer, in the wet condition, again bringing the layer into contact with a wetting liquid and then pressing the layer against a heated drum surface to thus obtain highly glossy finishing.

It is a matter of course that a protective layer may be applied onto the back face of the substrate and/or an intermediate layer may be formed between the substrate and the ink-receiving layer. More specifically, a variety of techniques known in the field of the ink jet-recording sheet production may be used in the present invention.

The term "liquid ink" used for recording or printing images is a recording liquid comprising a coloring agent, a liquid medium and other additives. In this connection, the liquid ink includes water based ink, and oil based ink.

Examples of coloring agents for water based ink are various kinds of water-soluble dyes such as direct dyes, acid dyes and reactive dyes.

In addition, examples of such liquid mediums for water-based ink include water or combinations of water and water-soluble organic solvents.

Specific examples of water-soluble organic solvents are monohydric alcohols such as ethyl alcohol and isopropyl alcohol; polyhydric alcohols such as ethylene glycol, diethylene glycol, polyethylene glycol and glycerin; and lower alkyl ethers of polyhydric alcohols such as triethylene glycol monomethyl ether, and triethylene glycol monoethyl ether.

The ink of the present invention may additionally comprise other additives such as a pH adjuster, a sequestering agent, an anti-fungus agent, a viscosity modifier, a surface tension modifier, a surfactant and a rust-proofing agent.

The present invention will hereunder be described in more detail with reference to the following working Examples, but the present invention is not restricted to these specific examples at all. In the following examples, the terms "part" and "%" represent "part by weight" and "% by weight" respectively, unless otherwise specified.

EXAMPLE I-1

Preparation of Coating Liquid a for Forming Ink-Receiving Layer

A coating liquid A for use in making an ink-receiving layer was prepared, which comprised 100 parts of synthetic amorphous silica (trade name: Fine Seal X60 available from Tokuyama Co., Ltd.), 250 parts of a 10% aqueous solution of silanol-modified polyvinyl alcohol (trade name: R1130 available from Kuraray Co., Ltd.), 75 parts of a 40% aqueous solution of diallylamine hydrochloride-acrylamide copolymer (trade name: Sumirez Resin 1001 available from Sumitomo Chemical Co., Ltd.), 200 parts of a 5% aqueous solution of 1,2-bis(2-hydroxyethylthio)ethane and small amounts of an anti-foaming agent and a dispersant as well as water, and the coating liquid had a solid content of 15%.

Preparation of Ink Jet-Recording Sheet

The coating liquid A prepared above was applied onto wood-free paper having a basis weight of 65 g/m$^2$ an amount of 12 g/m$^2$ as expressed in terms of the solid content using a wire bar and then dried to form an ink-receiving layer. Subsequently, the layer was subjected to a treatment with a super calender to thus form an ink jet-recording sheet.

EXAMPLES I-2 TO I-10

The same procedures used in Example I-1 were repeated except that the following compounds were substituted for the 1,2-bis(2-hydroxyethylthio)ethane used in Example I-1 to thus form each corresponding ink jet-recording sheet.

EXAMPLE I-2

1,4-bis(2-hydroxyethylthio)butane

EXAMPLE I-3

2,2'-thiodiethanol

EXAMPLE I-4

2,2'-dithiodiethanol

EXAMPLE I-5 bis(2-hydroxyethylthio)methane

EXAMPLE I-6

1,6-bis(2-hydroxyethylthio)hexane

EXAMPLE I-7 ethylthioethanol

EXAMPLE I-8 isopropylthioethanol

EXAMPLE I-9

1-ethylthio-2-(2-hydroxyethylthio)ethane

EXAMPLE I-10

1,2-bis(2,3-dihydroxypropylthio)ethane

EXAMPLES I-11 AND I-12

The same procedures used in Example I-1 were repeated except that the following compounds were substituted for the diallylamine hydrochloride-acrylamide copolymer (trade name: Sumirez Resin 1001 available from Sumitomo Chemical Co., Ltd.) used in Example I-1 to form each corresponding ink jet-recording sheet.

EXAMPLE I-11 diallylamine hydrochloride-sulfur dioxide copolymer (trade name: PAS-92 available from Nitto Boseki Co., Ltd.)

EXAMPLE I-12 poly(diallylmethylamine)hydrochloride (PAS-M-1 available from Nitto Boseki Co., Ltd.)

EXAMPLE I-13

Preparation of Coating Liquid B for Forming Ink-Receiving Layer

A coating liquid B for use in making an ink-receiving layer was prepared, which comprised 100 parts of synthetic amorphous silica (trade name: Fine Seal X60 available from Tokuyama Co., Ltd.), 250 parts of a 10% aqueous solution of silanol-modified polyvinyl alcohol (trade name: R1130 available from Kuraray Co., Ltd.), 75 parts of a 40% aqueous solution of diallylamine hydrochloride-acrylamide copolymer (trade name: Sumirez Resin 1001 available from Sumitomo Chemical Co., Ltd.) and small amounts of an anti-foaming agent and a dispersant as well as water, and which had a solid content of 15%.

Preparation of Ink Jet-Recording Sheet

The coating liquid B prepared above was applied onto wood-free paper having a basis weight of 65 g/m in an amount of 12 g/m$^2$ as expressed in terms of the solid content using a wire bar and then dried to form an ink-receiving layer. Subsequently, a 5% aqueous solution of 1,2-bis(2-hydroxyethylthio)ethane was applied onto the layer in an amount of 1.0 g/m as expressed in terms of the solid content using a wire bar and then dried. Thereafter, the layer thus treated was subjected to a treatment with a super calender to thus form an ink jet-recording sheet.

EXAMPLE I-14

Preparation of Coating Liquid C for Forming Gloss-Developing Layer

A coating liquid C for forming a gloss-developing layer was prepared, which included 100 parts of a composite of styrene-2-ethylhexyl acrylate copolymer having a glass transition temperature of 75° C. and colloidal silica (the weight ratio of the copolymer to the colloidal silica was found to be 40:60), 5 parts of a copolymer of an alkyl vinyl ether and a maleic acid derivative as a thickening-dispersant and 3 parts of lecithin as a releasing agent and which had a solid content of 30%.

Preparation of Ink Jet-Recording Sheet

An ink-receiving layer was formed on the surface of wood-free paper having a basis weight of 65 g/m$^2$ by applying the coating liquid A prepared in Example I-1 in an amount of 12 g/m$^2$ as expressed in terms of the solid content using a wire bar and then dried. Immediately after the coating liquid C prepared above was applied onto the ink-receiving layer, the layer was pressed against a mirror-finished drum whose surface temperature was set at 85° C., followed by drying and releasing the layer from the drum surface to thus give a glossy type ink jet-recording sheet provided thereon with a glossy layer. In this respect, the coated amount of the glossy layer was found to be 8 g/m$^2$ as expressed in terms of the solid content.

EXAMPLE I-15

Preparation of Coating Liquid D for Forming Gloss-Developing Layer

A coating liquid D for forming a gloss-developing layer was prepared, which included 100 parts of a composite of styrene-2-ethylhexyl acrylate copolymer having a glass transition temperature of 75° C. and colloidal silica (the weight ratio of the copolymer to the colloidal silica was found to be 40:60), 10 parts of 1,2-bis(2-hydroxyethylthio)ethane, 5 parts of a copolymer of an alkyl vinyl ether and a maleic acid derivative as a thickening-dispersant and 3 parts of lecithin as a releasing agent and which coating liquid D had a solid content of 30%.

Preparation of Ink Jet-Recording Sheet

An ink-receiving layer was formed on the surface of wood-free paper having a basis weight of 65 g/m$^2$ by applying the coating liquid A prepared in Example I-1 in an amount of 12 g/m$^2$ as expressed in terms of the solid content using a wire bar and then dried. Immediately after the coating liquid D prepared above was applied onto the ink-receiving layer, the layer was pressed against a mirror-finished drum whose surface temperature was set at 85° C. to dry, and the layer was released from the drum surface to thus give a glossy type ink jet-recording sheet provided thereon with a glossy layer. In this respect, the coated amount of the glossy layer was found to be 8 g/m$^2$ as expressed in terms of the solid content.

COMPARATIVE EXAMPLE I-1

The same procedures used in Example I-1 were repeated except that 1,2-bis(2-hydroxyethylthio)ethane was not used at all to thus give an ink jet-recording sheet.

COMPARATIVE EXAMPLE I-2

The same procedures used in Example I-1 were repeated except for using 50 parts of a 20% dispersion of dilauryl 3,3'-thiodipropionate prepared by the following method in place of 200 parts of the 5% aqueous solution of 1,2-bis(2-hydroxyethylthio)ethane used in Example I-1 to give an ink jet-recording sheet.

Preparation of Dispersion Containing Dilauryl 3,3'-Thiodipropionate

A dispersion was prepared by pulverizing a composition containing 100 parts of dilauryl 3,3'-thiodipropionate, 5 parts of sulfonate group-modified polyvinyl alcohol (trade name: Goselane L-3266 available from The Nippon Synthetic Chemical Industry, Co., Ltd.) and small amounts of a surfactant and an anti-foaming agent as well as water, and having a solid content of 20% in a sand grinder till the average particle size was reduced to 0.5 $\mu$m.

COMPARATIVE EXAMPLE I-3

The same procedures used in Comparative Example I-2 were repeated except that 2,6-di-tert-butyl-p-cresol was used instead of the dilauryl 3,3'-thiodipropionate used in Comparative Example I-2 to give an ink jet-recording sheet.

COMPARATIVE EXAMPLE I-4

The same procedures used in Example I-1 were repeated except that poly(diallyldimethylammonium)chloride (trade name: Unisense CP-103 available from Senka Co., Ltd.) was used instead of the diallylamine hydrochloride-acrylamide copolymer (trade name: Sumirez Resin 1001 available from Sumitomo Chemical Co., Ltd.) used in Example I-1 to give an ink jet-recording sheet.

COMPARATIVE EXAMPLE I-5

The same procedures used in Example I-1 were repeated except that polyethylene polyamine-dicyandiamide polycondensate (trade name: Neofix RP-70 available from Nikka Chemical Co., Ltd.) was used instead of the diallylamine hydrochloride-acrylamide copolymer (trade name: Sumirez Resin 1001 available from Sumitomo Chemical Co., Ltd.) used in Example I-1 to give an ink jet-recording sheet.

COMPARATIVE EXAMPLE I-6

The same procedures used in Example I-14 were repeated except that 1,2-bis(2-hydroxyethylthio)ethane was not used at all to give an ink jet-recording sheet.

The ink jet recording sheets prepared in the foregoing Examples and Comparative Examples were used in solid printing with mixed black ink obtained by the color mixing of cyan, magenta and yellow dyes and with cyan ink and also used in printing ISO-400 images ("Highly Precise and Fine Color Digital Standard Image Data: ISO/JIS-SCID", p. 13, Kind of Image: Portrait, published by Foundation: Nippon Kikaku Kyokai) using Epson Ink Jet Printer PM-800C and then these sheets were evaluated according to the following methods. The results thus obtained are listed in the following Table 1. In this connection, a phthalocyanine dye is used in PM-800C as a cyan dye.

Density of Printed Matter

The densities of the solid portion printed with the mixed black ink obtained by the color mixing of cyan, magenta and yellow dyes and with cyan ink were determined using Macbeth's Densitometer (Model RD-914 available from Macbeth Company).

Quality of Image

The ISO-400 images were observed with the naked eyes to thus evaluate the quality thereof.

Evaluation Criteria

◎: quite excellent;

○: excellent; and x: inferior.

Resistance to Ozone

These sheets were inspected for the resistance to ozone, which was recognized to have strong correlation with the long-term storability. Solid printed portions and ISO-400 images were formed on these sheets with the mixed black ink obtained by the color mixing of cyan, magenta and yellow dyes and with cyan ink and then allowed to stand in a container having an ozone concentration of 10 ppm over 12 hours. In case of the solid printed portion, the Macbeth's density was determined after the foregoing test to thus calculate the rate of remaining image according to the following equation. On the other hand, the ISO-400 image was visually inspected for the degree of color change, which was ranked according to the following evaluation criteria: Rate of Remaining Image (%)=[(Density Observed After Treatment)/(Density Observed Prior to Treatment)]×100

Evaluation Criteria

◎: There was not observed any color change and discoloration.

○: There was observed a slight color change and discoloration, but the image could practically be acceptable.

x: There was observed severe color change and discoloration and the image could not practically be acceptable.

TABLE 1

| Ex. | Printed Density | | Quality of | Resistance to Ozone | | |
|---|---|---|---|---|---|---|
| | | | | Rate of Remaining Black Image | Rate of Remaining Cyan Image | |
| No. | Black | Cyan | Image | (%) | (%) | Image |
| I-1 | 1.77 | 1.56 | ◎ | 85.3 | 88.5 | ◎ |
| I-2 | 1.74 | 1.53 | ◎ | 84.5 | 87.5 | ◎ |
| I-3 | 1.72 | 1.50 | ○ | 76.5 | 77.4 | ○ |
| I-4 | 1.70 | 1.48 | ○ | 77.6 | 79.5 | ○ |
| I-5 | 1.73 | 1.51 | ○ | 76.8 | 78.8 | ○ |
| I-6 | 1.73 | 1.50 | ○ | 76.8 | 79.7 | ○ |
| I-7 | 1.71 | 1.52 | ○ | 76.8 | 77.7 | ○ |
| I-8 | 1.70 | 1.51 | ○ | 76.1 | 77.2 | ○ |
| I-9 | 1.73 | 1.52 | ○ | 78.5 | 79.2 | ○ |
| I-10 | 1.71 | 1.52 | ○ | 77.8 | 78.9 | ○ |
| I-11 | 1.73 | 1.51 | ◎ | 84.2 | 87.3 | ◎ |
| I-12 | 1.72 | 1.50 | ◎ | 80.5 | 82.7 | ◎ |
| I-13 | 1.75 | 1.53 | ○ | 85.5 | 88.9 | ◎ |
| I-14 | 1.85 | 1.64 | ◎ | 84.7 | 87.4 | ◎ |
| I-15 | 1.84 | 1.62 | ◎ | 86.8 | 89.6 | ◎ |
| I-1* | 1.65 | 1.45 | ○ | 57.5 | 66.4 | X |
| I-2* | 1.46 | 1.25 | X | 58.6 | 66.8 | X |
| I-3* | 1.52 | 1.31 | X | 56.8 | 64.5 | X |
| I-4* | 1.75 | 1.54 | ◎ | 53.2 | 60.5 | X |
| I-5* | 1.56 | 1.33 | ○ | 59.8 | 68.3 | X |
| I-6* | 1.80 | 1.59 | ○ | 56.8 | 65.6 | ○ |

COMPARATIVE EXAMPLE

As will be seen from the data listed in Table 1, the ink jet-recording sheet according to the present invention can ensure a high density of printed images, can provide images having high quality, shows only a slight color change and discoloration of printed images even when exposed to ozone gas and is excellent in the long-term shelf life.

EXAMPLE II-1

Preparation of Coating Liquid A for Forming Ink-Receiving Layer

A coating liquid A for use in making an ink-receiving layer was prepared, which comprised 100 parts of synthetic amorphous silica (trade name: Fineseal X60 available from Tokuyama Co., Ltd.), 25 parts of silanol-modified polyvinyl alcohol (trade name: R1130 available from Kuraray Co., Ltd.), 30 parts of diallylamine hydrochloride-acrylamide copolymer (trade name: Sumirez Resin 1001 available from Sumitomo Chemical Co., Ltd.), 100 parts of a 10% aqueous solution of disodium 3,3'-thiodipropionate and small amounts of an anti-foaming agent and a dispersant as well as water, and which had a solid content of 15%.

Preparation of Ink Jet-Recording Sheet

The coating liquid A prepared above was applied onto wood-free paper having a basis weight of 65 g/m$^2$ in an amount of 12 g/m$^2$ as expressed in terms of the solid content using a wire bar and then dried to form an ink-receiving layer. Thereafter, the ink jet recording sheet thus formed was subjected to a treatment with a super calender to thus form an ink jet-recording sheet.

EXAMPLES II-2 TO II-8

The same procedures used in Example II-1 were repeated except that the following compounds were substituted for the disodium 3,3'-thiodipropionate used in Example II-1 to thus give each corresponding ink jet-recording sheet.

EXAMPLE II-2 disodium 3,3'-dithiodipropionate

EXAMPLE II-3 disodium 2,2'-thiodiglycolate

EXAMPLE II-4 disodium 4,4'-thiodibutanoate

EXAMPLE II-5 disodium 6,6'-thiodicaproate

EXAMPLE II-6 diammonium 3,3-thiodipropionate

EXAMPLE II-7 calcium 3,3'-thiodipropionate

EXAMPLE II-8 magnesium 3,3'-thiodipropionate

EXAMPLE II-9

The same procedures used in Example II-1 were repeated except that 50 parts of a 20% dispersion of 3,3'-thiodipropionic acid prepared by the following method was substituted for 100 parts of the 10% aqueous solution of disodium 3,3'-thiodipropionate to thus form an ink jet-recording sheet.

Preparation of the Dispersion of 3,3'-Thiodipropionic Acid

A dispersion was prepared by pulverizing a composition, which comprises 100 parts of 3,3'-thiodipropionic acid, 5 parts of sulfonate group-modified polyvinyl alcohol (trade name: Goselane L-3266 available from The Nippon Synthetic Chemical Industry, Co., Ltd.), small amounts of a surfactant and an anti-foaming agent as well as water and which had a solid content of 20% till the average particle size was reduced to 0.5 $\mu$m, using a sand grinder.

EXAMPLES II-10 AND II-11

The same procedures used in Example II-9 were repeated except that the following compounds were substituted for the 3,3'-thiodipropionic acid used in Example II-9 to thus form each corresponding ink jet-recording sheet.

EXAMPLE II-10 zinc 3,3'-thiodipropionate

EXAMPLE II-11

3,3'-dithiodipropionic acid

EXAMPLE II-12

Preparation of Coating Liquid B for Forming Ink-Receiving Layer

A coating liquid B for use in making an ink-receiving layer was prepared, which comprised 100 parts of synthetic amorphous silica (trade name: Fine Seal X60 available from Tokuyama Co., Ltd.), 25 parts of silanol-modified polyvinyl alcohol (trade name: R1130 available from Kuraray Co., Ltd.), 30 parts of diallylamine hydrochloride-acrylamide copolymer (trade name: Sumirez Resin 1001 available from Sumitomo Chemical Co., Ltd.) and small amounts of an anti-foaming agent and a dispersant as well as water, and which had a solid content of 15%.

Preparation of Ink Jet-Recording Sheet

The coating liquid B prepared above was applied onto wood-free paper having a basis weight of 65 g/m$^2$ in an amount of 12 g/m$^2$ as expressed in terms of the solid content using a wire bar and then dried to form an ink-receiving layer. Subsequently, a 5% aqueous solution of di-sodium 3,3'-thiodipropionate was further applied onto the ink-receiving layer using a wire bar in an amount of 11.0 g/m$^2$ in terms of solid and dried and then the layer was subjected to a super calender treatment to thus form an ink jet-recording sheet.

EXAMPLE II-13

The same procedures used in Example II-12 were repeated except that disodium 3,3'-dithiodipropionate was substituted for the disodium 3,3'-thiodipropionate used in Example II-12 to form an ink jet-recording sheet.

COMPARATIVE EXAMPLE II-1

The same procedures used in Example II-1 were repeated except that disodium 3,3'-thiodipropionate was not used at all to give an ink jet-recording sheet.

COMPARATIVE EXAMPLES II-2 and II-3

The same procedures used in Example II-9 were repeated except that the following compounds were used in place of 100 parts of the 3,3'-thiodipropionic acid to form each corresponding ink jet-recording sheet.

COMPARATIVE EXAMPLE II-2

100 parts of dilauryl 3,3'-thiodipropionate

COMPARATIVE EXAMPLE II-3

100 parts of 2,6-di-tert-butyl-p-cresol

The ink jet recording sheets prepared in the foregoing Examples and Comparative Examples were used in solid printing with mixed black ink obtained by the color mixing of cyan, magenta and yellow dyes and with cyan ink and also used in printing ISO-400 images ("Highly Precise and Fine Color Digital Standard Image Data: ISO/JIS-SCID", p. 13, Kind of Image: Portrait, published by Foundation: Nippon Kikaku Kyokai) using Epson Ink Jet Printer PM-800C and then these sheets were evaluated in the same manner used in Example I-1. The results thus obtained are listed in the following Table 2. In this connection, a phthalocyanine dye is used in PM-800C as a cyan dye.

TABLE 2

| Ex. | Printed Density | | Quality of | Resistance to Ozone | | |
|---|---|---|---|---|---|---|
| | | | | Rate of Remaining Black Image | Rate of Remaining Cyan Image | |
| No. | Black | Cyan | Image | (%) | (%) | Image |
| II-1 | 1.75 | 1.55 | ◎ | 82.0 | 85.4 | ◎ |
| II-2 | 1.73 | 1.51 | ◎ | 84.3 | 87.2 | ◎ |
| II-3 | 1.71 | 1.49 | ○ | 77.5 | 79.8 | ○ |
| II-4 | 1.68 | 1.46 | ◎ | 73.6 | 77.3 | ○ |
| II-5 | 1.65 | 1.45 | ◎ | 72.5 | 76.4 | ○ |
| II-6 | 1.75 | 1.51 | ◎ | 83.2 | 86.5 | ◎ |
| II-7 | 1.66 | 1.47 | ○ | 81.2 | 83.5 | ◎ |
| II-8 | 1.65 | 1.45 | ○ | 82.2 | 84.7 | ◎ |
| II-9 | 1.69 | 1.51 | ○ | 82.5 | 86.2 | ◎ |
| II-10 | 1.65 | 1.45 | ○ | 81.6 | 84.6 | ◎ |
| II-11 | 1.67 | 1.50 | ○ | 83.6 | 86.2 | ◎ |
| II-12 | 1.73 | 1.52 | ○ | 82.6 | 85.7 | ◎ |
| II-13 | 1.71 | 1.51 | ○ | 84.7 | 86.5 | ◎ |
| II-1* | 1.65 | 1.45 | ○ | 57.5 | 66.4 | X |
| II-2* | 1.46 | 1.25 | X | 58.6 | 66.8 | X |
| II-3* | 1.52 | 1.31 | X | 56.8 | 64.5 | X |

COMPARATIVE EXAMPLE

As will be seen from the data listed in Table 2, the ink jet-recording sheet according to the present invention can ensure a high density of printed images, can provide images having high quality, shows only a slight color change and discoloration of printed images even when exposed to ozone gas and is excellent in the long-term shelf life.

EXAMPLE III-1

Preparation of Dispersion of 3,3'-Dithiobis(2-Aminopropionic Acid)

A dispersion was prepared by pulverizing a composition, which comprised 100 parts of 3,3'-dithiobis(2-aminopropionic acid), 5 parts of sulfonate group-modified polyvinyl alcohol (trade name: Goselane L-3266 available from The Nippon Synthetic Chemical Industry, Co., Ltd.) and small amounts of a surfactant and an anti-foaming agent as well as water, and which had a solid content of 20% till the average particle size was reduced to 0.5 $\mu$m, using a sand grinder.

Preparation of Coating Liquid for Forming Ink-Receiving Layer

A coating liquid for use in making an ink-receiving layer was prepared, which comprised 100 parts of synthetic amorphous silica (trade name: Fine Seal X60 available from Tokuyama Co., Ltd.), 250 parts of a 10% aqueous solution of silanol-modified polyvinyl alcohol (trade name: R1130 available from Kuraray Co., Ltd.), 75 parts of a 40% aqueous solution of diallylamine hydrochloride-acrylamide copolymer (trade name: Sumirez Resin 1001 available from Sumitomo Chemical Co., Ltd.), 50 parts of a 20% dispersion containing 3,3'-dithiobis(2-aminopropionic acid) and small amounts of an anti-foaming agent and a dispersant as well as water, and which had a solid content of 15%.

Preparation of Ink Jet-Recording Sheet

The coating liquid prepared above was applied onto wood-free paper having a basis weight of 65 g/m$^2$ in an amount of 12 g/m$^2$ as expressed in terms of the solid content using a wire bar and then dried to form an ink-receiving layer. Subsequently, the ink-receiving layer was subjected to a super calender treatment to thus form an ink jet-recording sheet.

EXAMPLES III-2 TO III-5

The same procedures used in Example III-1 were repeated except that the following compounds were substituted for the 3,3'-dithiobis(2-aminopropionic acid) used in Example III-1 to form each corresponding ink jet-recording sheet.

EXAMPLE III-2

3,3'-dithiobis(2-aminopropionic acid)dihydrochloride

EXAMPLE III-3

3,3'-thiobis(2-aminopropionic acid)

EXAMPLE III-4 dimethyl 3,3'-dithiobis(2-aminopropionate)

EXAMPLE III-5

3,3'-dithiobis(2-N-acetylaminopropionic acid)

EXAMPLE III-6

Preparation of Coating Liquid for Forming Gloss-Developing Layer

A coating liquid for forming a gloss-developing layer was prepared, which comprised 100 parts of a composite of styrene-2-ethylhexyl acrylate copolymer having a glass transition temperature of 75° C. and colloidal silica (the weight ratio of the copolymer to the colloidal silica was set at 40:60), 5 parts of a copolymer of alkyl vinyl ether and maleic acid derivative as a thickening-dispersant and 3 parts of lecithin as a releasing agent and which had a solid content of 30%.

Preparation of Ink Jet-Recording Sheet

An ink-receiving layer was formed on the surface of wood-free paper having a basis weight of 65 g/m$^2$ by applying the coating liquid for forming an ink-receiving layer prepared in Example III-1 in an amount of 12 g/m$^2$ as expressed in terms of the solid content using a wire bar and then dried. Immediately after the coating liquid for forming a gloss-developing layer prepared above was applied onto the ink-receiving layer, the layer was pressed against a mirror-finished drum whose surface temperature was set at 85° C., followed by drying and releasing the layer from the drum surface to thus give a glossy type ink jet-recording sheet provided thereon with a glossy layer. In this respect, the coated amount of the glossy layer was found to be 8 g/m$^2$ as expressed in terms of the solid content.

COMPARATIVE EXAMPLE III-1

The same procedures used in Example III-1 were repeated except that the 3,3'-dithiobis(2-aminopropionic acid) was not used at all to thus form an ink jet-recording sheet.

COMPARATIVE EXAMPLE III-2

The same procedures used in Example III-1 were repeated except that dilauryl 3,3'-thiodipropionate was used in place of the 3,3'-dithiobis(2-aminopropionic acid) used in Example III-1 to thus form an ink jet-recording sheet.

COMPARATIVE EXAMPLE III-3

The same procedures used in Example III-1 were repeated except that 2,6-di-tert-butyl-p-cresol was used in place of the 3,3'-dithiobis(2-aminopropionic acid) used in Example III-1 to thus form an ink jet-recording sheet.

COMPARATIVE EXAMPLE III-4

The same procedures used in Example III-6 were repeated except that the 3,3'-dithiobis(2-aminopropionic acid) was not used at all to thus form an ink jet-recording sheet.

The ink jet recording sheets prepared in the foregoing Examples and Comparative Examples were used in solid printing with mixed black ink obtained by the color mixing of cyan, magenta and yellow dyes and with cyan ink and also used in printing ISO-400 images ("Highly Precise and Fine Color Digital Standard Image Data: ISO/JIS-SCID", p. 13, Kind of Image: Portrait, published by Foundation: Nippon Kikaku Kyokai) using Epson Ink Jet Printer PM-800C and then these sheets were evaluated in the same manner used in Example I-1. The results thus obtained are listed in the following Table 3. In this connection, a phthalocyanine dye is used in PM-800C as a cyan dye.

TABLE 3

| Ex. | Printed Density | | Quality of | Resistance to Ozone | | Image |
|---|---|---|---|---|---|---|
| | | | | Rate of Remaining Black Image | Rate of Remaining Cyan Image | |
| No. | Black | Cyan | Image | (%) | (%) | Quality |
| III-1 | 1.68 | 1.52 | ○ | 82.6 | 86.7 | ◎ |
| III-2 | 1.65 | 1.48 | ○ | 82.4 | 86.4 | ◎ |
| III-3 | 1.66 | 1.50 | ○ | 73.4 | 76.4 | ○ |
| III-4 | 1.67 | 1.52 | ○ | 74.5 | 78.3 | ○ |
| III-5 | 1.65 | 1.49 | ○ | 74.1 | 77.9 | ○ |
| III-6 | 1.83 | 1.62 | ◎ | 82.8 | 87.1 | ◎ |
| III-1* | 1.65 | 1.45 | ○ | 57.5 | 66.4 | X |
| III-2* | 1.46 | 1.25 | X | 58.6 | 66.8 | X |
| III-3* | 1.52 | 1.31 | X | 56.8 | 64.5 | X |
| III-4* | 1.77 | 1.56 | ○ | 56.8 | 60.5 | X |

COMPARATIVE EXAMPLE

As will be seen from the data listed in Table 3, the ink jet-recording sheet according to the present invention can ensure a high density of printed images, can provide images having high quality, shows only a slight color change and discoloration of printed images even when exposed to ozone gas and is excellent in the long-term shelf life.

EXAMPLE IV-1

Preparation of Dispersion of 1,4-Bis(Phenylthio)Butane

A dispersion was prepared by pulverizing a composition, which comprised 100 parts of 1,4-bis(phenylthio)butane, 5 parts of sulfonate group-modified polyvinyl alcohol (trade name: Goselane L-3266 available from The Nippon Synthetic Chemical Industry, Co., Ltd.) and small amounts of a surfactant and an anti-foaming agent as well as water, and which had a solid content of 20% till the average particle size was reduced to 0.5 $\mu$m, using a sand grinder.

Preparation of Coating Liquid for Forming Ink-Receiving Layer

A coating liquid for use in making an ink-receiving layer was prepared, which comprised 100 parts of synthetic amorphous silica (trade name: Fine Seal X60 available from Tokuyama Co., Ltd.), 250 parts of a 10% aqueous solution of silanol-modified polyvinyl alcohol (trade name: R1130 available from Kuraray Co., Ltd.), 75 parts of a 40% aqueous solution of diallylamine hydrochloride-acrylamide copolymer (trade name: Sumirez Resin 1001 available from Sumitomo Chemical Co., Ltd.), 50 parts of a 20% dispersion containing 1,4-bis(phenylthio)butane and small amounts of an anti-foaming agent and a dispersant as well as water, and which had a solid content of 15%.

Preparation of Ink Jet-Recording Sheet

The coating liquid prepared above was applied onto wood-free paper having a basis weight of 65 g/m$^2$ in an amount of 12 g/m$^2$ as expressed in terms of the solid content using a wire bar and then dried to form an ink-receiving layer. Subsequently, the ink jet recording sheet was subjected to a super calender treatment to thus form an ink jet-recording sheet.

EXAMPLES IV-2 TO IV-5

The same procedures used in Example IV-1 were repeated except that the following compounds were substituted for the 1,4-bis(phenylthio)butane used in Example IV-1 to form each corresponding ink jet-recording sheet.

EXAMPLE IV-2

1,6-bis(phenylthio)hexane

EXAMPLE IV-3

1,4-bis(4-methylphenylthio)butane

EXAMPLE IV-4

1,2-bis(phenylthio)ethane

EXAMPLE IV-5

Preparation of Coating Liquid for Forming Gloss-Developing Layer

A coating liquid for forming a gloss-developing layer was prepared, which comprised 100 parts of a composite of styrene-2-ethylhexyl acrylate copolymer having a glass transition temperature of 75° C. and colloidal silica (the weight ratio of the copolymer to the colloidal silica was set at 40:60), 5 parts of a copolymer of alkyl vinyl ether and maleic acid derivative as a thickening-dispersant and 3 parts of lecithin and which had a solid content of 30%.

Preparation of Ink Jet-Recording Sheet

An ink-receiving layer was formed on the surface of wood-free paper having a basis weight of 65 g/m$^2$ by applying the coating liquid for forming an ink-receiving layer prepared in Example IV-1 in an amount of 12 g/m$^2$ as expressed in terms of the solid content using a wire bar and then dried. Immediately after the coating liquid for forming a gloss-developing layer prepared above was applied onto the ink-receiving layer, the layer was pressed against a mirror-finished drum whose surface temperature was set at 85° C. to dry and the layer was released from the drum surface to thus give a glossy type ink jet-recording sheet provided thereon with a glossy layer. In this respect, the coated amount of the glossy layer was found to be 8 g/m$^2$ as expressed in terms of the solid content.

COMPARATIVE EXAMPLE IV-1

The same procedures used in Example IV-1 were repeated except that the 1,4-bis(phenylthio)butane was not used at all to thus form an ink jet-recording sheet.

COMPARATIVE EXAMPLE IV-2

The same procedures used in Example IV-1 were repeated except that dilauryl 3,3'-thiodipropionate was used instead of the 1,4-bis(phenylthio)butane used in Example IV-1 to thus form an ink jet-recording sheet.

COMPARATIVE EXAMPLE IV-3

The same procedures used in Example IV-1 were repeated except that 2,6-di-tert-butyl-p-cresol was used instead of the 1,4-bis(phenylthio)butane used in Example IV-1 to thus form an ink jet-recording sheet.

COMPARATIVE EXAMPLE IV-4

The same procedures used in Example IV-5 were repeated except that the 1,4-bis(phenylthio)butane was not used at all to thus form an ink jet-recording sheet.

The ink jet recording sheets prepared in the foregoing Examples and Comparative Examples were used in solid printing with mixed black ink obtained by the color mixing of cyan, magenta and yellow dyes and with cyan ink and also used in printing ISO-400 images ("Highly Precise and Fine Color Digital Standard Image Data: ISO/JIS-SCID", p. 13, Kind of Image: Portrait, published by Foundation: Nippon Kikaku Kyokai) using Epson Ink Jet Printer PM-800C and then these sheets were evaluated in the same manner used in Example I-1. The results thus obtained are listed in the following Table 4. In this connection, a phthalocyanine dye is used in PM-800C as a cyan dye.

TABLE 4

| Ex. | Printed Density | | Resistance to Ozone | | |
|---|---|---|---|---|---|
| | | | Rate of Remaining Black Image | Rate of Remaining Cyan Image | Quality of |
| No. | Black | Cyan | (%) | (%) | Image |
| IV-1 | 1.69 | 1.54 | 81.5 | 84.6 | ◎ |
| IV-2 | 1.68 | 1.53 | 81.1 | 84.2 | ◎ |
| IV-3 | 1.65 | 1.50 | 75.7 | 78.4 | ○ |
| IV-4 | 1.63 | 1.51 | 73.5 | 76.7 | ○ |
| IV-5 | 1.83 | 1.62 | 82.1 | 85.3 | ◎ |
| IV-1* | 1.65 | 1.47 | 57.5 | 66.5 | X |
| IV-2* | 1.48 | 1.27 | 58.5 | 66.9 | X |
| IV-3* | 1.53 | 1.32 | 56.8 | 64.5 | X |
| IV-4* | 1.77 | 1.56 | 56.5 | 65.3 | X |

COMPARATIVE EXAMPLE

As will be seen from the data listed in Table 4, the ink jet-recording sheet according to the present invention can ensure a high density of printed images, shows only a slight color change and discoloration of printed images even when exposed to ozone gas and is excellent in the long-term shelf life.

What is claimed is:

1. A method of preparing an ink jet-recording sheet for forming recorded images using liquid ink, which comprises the step of applying an ink-receiving layer containing components (a) and (b) onto a substrate.

component (a): at least one member selected from the group consisting of those represented by the following general formulae (1) to (5) and salts of compounds represented by the following general formulae (3) and (4);

component (b): at least one member selected from the group consisting of homopolymers of diallylamine compounds represented by the following general formula (6) and copolymers of the compounds of formula (6) with copolymerizable ethylenically unsaturated compounds.

$$HO—(C_2H_4(S)_r)_p—R_1 \quad (1)$$

$$R_2—(S)_t—(CH_2)_q—(S)_t—R_3 \quad (2)$$

$$HOOC—(CH_2)_l—(S)_n—(CH_2)_m—COOH \quad (3)$$

(4)

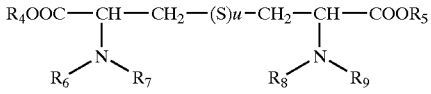

(5)

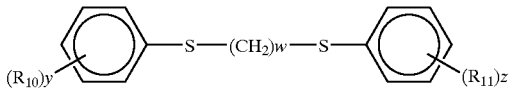

wherein $R_1$, $R_2$ and $R_3$ each represents a $C_1$ to $C_4$ alkyl group, a $C_1$ to $C_4$ hydroxyalkyl group or a $C_1$ to $C_4$ dihydroxyalkyl group; $R_4$ and $R_5$ each (6)

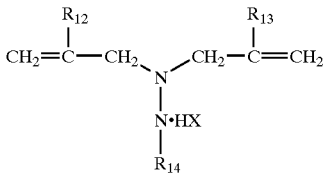

represents a hydrogen atom or a $C_1$ to $C_4$ alkyl group; $R_6$ to $R_9$ each represents a hydrogen atom, a $C_1$ to $C_4$ alkyl group, a $C_1$ to $C_4$ alkylcarbonyl group or a benzoyl group; $R_{10}$ and $R_{11}$ each represents a $C_1$ to $C_4$ alkyl group or a $C_1$ to $C_4$ alkoxy group; $R_{12}$ and $R_{13}$ each represents a hydrogen atom or a methyl group; $R_{14}$ represents a hydrogen atom or a $C_1$ to $C_4$ alkyl group; and HX represents an acid, and p represents an integer ranging from 1 to 3; q represents an integer ranging from 1 to 6; r, t, n and u each represents 1 or 2; 1 and m each represents an integer ranging from 1 to 11; w represents an integer ranging from 1 to 6; y and z each represents 0 or an integer ranging from 1 to 3.

2. The method of claim 1, wherein the compound represented by the general formula (1) is 1,2-bis(2-hydroxyethylthio)ethane.

3. The method of claim 1, wherein the compound represented by the general formula (2) is 1,4-bis(2-hydroxyethylthio)butane.

4. The method of claim 1, wherein the compound represented by the general formula (3) is 3,3'-thiodipropionic acid or 3,3'-dithiodipropionic acid.

5. The method of claim 1, wherein the compound represented by the general formula (4) is 3,3'-dithiobis(2-aminopropionic acid).

6. The method of claim 1, wherein the compound represented by the general formula (5) is 1,4-bis(phenylthio) butane or 1,6-bis(phenylthio)hexane.

7. The method of claim 1, which further comprises subjecting the ink-receiving layer to a casting treatment.

8. The method of claim 1, which further comprises forming a glossy layer on the ink-receiving layer.

9. A method of preparing an ink jet-recording sheet for forming recorded images using liquid ink, which comprises the steps of applying an ink-receiving layer containing the following component (b) onto a substrate, and applying the following component (a) onto the surface of the ink-receiving layer.

component (a): at least one member selected from the group consisting of those represented by the following general formulae (1) to (5) and salts of compounds represented by the following general formulae (3) and (4);

component (b): at least one member selected from the group consisting of homopolymers of diallylamine compounds represented by the following general formula (6) and copolymers of the compounds of formula (6) with copolymerizable ethylenically unsaturated compounds.

$$HO—(C_2H_4(S)_r)_p—R_1 \quad (1)$$

$$R_2—(S)_t—(CH_2)_q—(S)_t—R_3 \quad (2)$$

$$HOOC—(CH_2)_1—(S)_n—(CH_2)_m—COOH \quad (3)$$

(4)

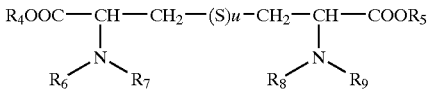

(5)

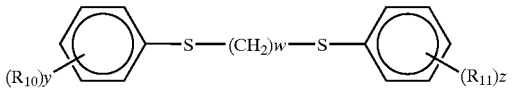

wherein $R_1$, $R_2$ and $R_3$ each represents a $C_1$ to $C_4$ alkyl group, a $C_1$ to $C_4$ hydroxyalkyl group or a $C_1$ to $C_4$ dihydroxyalkyl group;

(6)

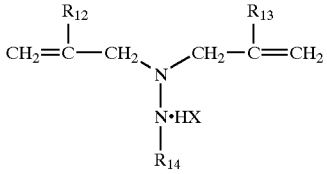

$R_4$ and $R_5$ each represents a hydrogen atom or a $C_1$ to $C_4$ alkyl group; $R_6$ to $R_9$ each represents a hydrogen atom, a $C_1$ to $C_4$ alkyl group, a $C_1$ to $C_4$ alkylcarbonyl group or a benzoyl group; $R_{10}$ and $R_{11}$ each represents a $C_1$ to $C_4$ alkyl group or a $C_1$ to $C_4$ alkoxy group; $R_{12}$ and $R_{13}$ each represents a hydrogen atom or a methyl group; $R_{14}$ represents a hydrogen atom or a $C_1$ to $C_4$ alkyl group; and HX represents an acid, and p represents an integer ranging from 1 to 3; q represents an integer ranging from 1 to 6; r, t, n and u each represents 1 or 2; 1 and m each represents an integer ranging from 1 to 11; w represents an integer ranging from 1 to 6; y and z each represents 0 or an integer ranging from 1 to 3.

10. The method of claim 9, wherein the compound represented by the general formula (1) is 1,2-bis(2-hydroxyethylthio)ethane.

11. The method of claim 9, wherein the compound represented by the general formula (2) is 1,4-bis(2-hydroxyethylthio)butane.

12. The method of claim 9, wherein the compound represented by the general formula (3) is 3,3'-thiodipropionic acid or 3,3'-dithiodipropionic acid.

13. The method of claim 9, wherein the compound represented by the general formula (4) is 3,3'-dithiobis(2-aminopropionic acid).

14. The method of claim 9, wherein the compound represented by the general formula (5) is 1,4-bis(phenylthio) butane or 1,6-bis(phenylthio)hexane.

* * * * *